US005441204A

United States Patent [19]

Tappel et al.

[11] Patent Number: 5,441,204

[45] Date of Patent: Aug. 15, 1995

[54] ELECTROSTATIC FLUID DISTRIBUTION NOZZLE

[75] Inventors: Daniel R. Tappel; Frederick R. Wichmann, both of Cincinnati, Ohio

[73] Assignee: United Air Specialists, Inc., Cincinnati, Ohio

[21] Appl. No.: 275,652

[22] Filed: Jul. 15, 1994

Related U.S. Application Data

[63] Continuation of Ser. No. 74,496, Jun. 10, 1993, abandoned.

[51] Int. Cl.[6] ..... B05B 5/02

[52] U.S. Cl. ..... 239/708; 239/565; 239/597

[58] Field of Search ..... 239/690, 690.1, 708, 239/555, 565, 566, 568, 597

[56] References Cited

U.S. PATENT DOCUMENTS

| | | | |
|---|---|---|---|
| 2,454,123 | 10/1949 | Scherl | 239/568 |
| 2,685,536 | 8/1954 | Starkey et al. . | |
| 2,706,964 | 4/1955 | Ransburg et al. . | |
| 3,020,579 | 2/1962 | O'Conner | 239/565 |
| 3,508,711 | 4/1970 | Switall . | |
| 3,615,054 | 10/1971 | Botz . | |
| 4,150,644 | 4/1979 | Masaki et al. | 239/696 X |
| 4,749,125 | 6/1988 | Escallon et al. . | |
| 4,788,016 | 11/1988 | Colclough et al. . | |
| 4,814,788 | 3/1989 | Davies . | |
| 4,830,872 | 5/1989 | Gresfell | 239/690 X |
| 5,086,973 | 2/1992 | Escallon et al. . | |
| 5,209,410 | 5/1993 | Wichmann et al. | 239/568 X |

FOREIGN PATENT DOCUMENTS

| | | | |
|---|---|---|---|
| 269313 | 9/1963 | Australia . | |
| 2830316 | 1/1980 | Germany . | |
| 1004267 | 9/1965 | United Kingdom | 239/690 |
| 239568 | 11/1971 | United Kingdom . | |

*Primary Examiner*—Andres Kashnikow
*Assistant Examiner*—Kevin Weldon
*Attorney, Agent, or Firm*—Frost & Jacobs

[57] ABSTRACT

A uniform distribution nozzle for electrostatic dispensing of conductive fluids, wherein the nozzle includes a nozzle body having a base and an attached cap, and an inlet for receiving fluid at a relatively low pressure. A substantially elongated outlet opening is provided on the nozzle for enabling distribution of the fluid, and a conductive shim is preferably included for providing an electrical charge to the fluid to enable electrostatic distribution from the nozzle. In a preferred embodiment, a plurality of distribution channels are provided to define discrete pathways within the nozzle for distributing and directing the fluid from the inlet to predetermine dispensing points along the outlet opening. The pathways have substantially equal flow characteristics, so that fluid travels with substantially equivalent volume, speed and pressure between the inlet and the outlet opening, regardless of which particular pathway and dispensing point are involved. The distribution channels are part of the overall distribution chamber provided within the nozzle for receiving conductive fluid and directing it to the outlet opening in a uniform and consistent manner.

7 Claims, 5 Drawing Sheets

ELECTROSTATIC FLUID DISTRIBUTION NOZZLE

This is a continuation of application Ser. No. 08/074,496, filed Jun. 10, 1993, now abandoned.

TECHNICAL FIELD

This invention relates to distribution nozzles for use with devices for electrostatically dispensing flowable, conductive fluids onto a predetermined target, and more particularly, to a nozzle assembly having an improved internal distribution chamber with discrete pathways to insure uniform, reliable distribution of the fluid at relatively low pressure for consistent and uniform distribution across the width of the nozzle outlet opening. In a preferred embodiment, matched distribution channels define a network within the nozzle body which systematically branches the fluid flow from an inlet to a plurality of spaced distribution points adjacent the outlet opening.

BACKGROUND ART

As set forth in the commonly assigned U.S. Pat. No. 5,209,410 in the names of Wichmann, et al., the applications in which conductive, flowable materials are to be relatively uniformly applied onto a predetermined target are numerous, varied and constantly growing. While conventional spraying or coating techniques, dipping, wiping, soaking, and other applications and procedures have been implemented with varying degrees of acceptability in the industry, increased control of reliability and efficiency of the quality and the coverage of dispensing systems continues to be a driving force for continued development in this industry.

For example, it has been observed that nozzles made in accordance with the teachings of various dispensing nozzles and devices heretofore available (e.g., U.S. Pat. No. 4,749,125, Escallon et al.), can encounter problems in providing an application spray of predetermined, uniform consistency for dispensing materials at a predetermined coverage rate. The lack of ability to carefully control the volume of material coated onto a predetermined target area, and lack of control of the resulting uniformity in such applications has been successfully addressed by the electrostatic dispensing nozzle assembly disclosed in the above noted Wichmann et al. patent. The disclosure of the Wichmann et al. patent is hereby incorporated herein by reference. Particularly, the Wichmann, et al. nozzle assembly provides a device for electrostatically dispensing a flowable material onto a target at a predetermined application rate, and further enables enhanced control of the dispensing operations by providing a plurality of substantially hydraulically independent distribution chambers and attachment of each chamber to a source of flowable material. By selective supply of the flowable material to the individual chambers, critical control, uniformity, adaptability, and consistency of fluid distribution is conveniently provided without sacrificing performance or set-up time, and without a requirement for changes of equipment or structure. The pressure of the flowable material in the Wichmann, et al. dispensing nozzle assembly is maintained at a relatively low value, as the substantially delta-shaped chambers facilitate proper distribution of fluid within the nozzle without requiring higher pressures.

While the use of delta-shaped chambers has been found to be effective in providing substantially uniform flow of material within electrostatic nozzles for distribution across the width of the outlet opening of the nozzle, in some applications where uniformity of distribution across the width of the nozzle is critical, even further control of uniformity and distribution rate is desirable. For example, where tolerances of material application rates (e.g. thickness of distributed fluid) is relatively small (e.g. within 0.1–2 mils), even the most accurate and reliable nozzles heretofore available were not always dependable. Materials from which the nozzles have been produced limited the control which could be achieved by tight manufacturing procedures and designs, and the varying characteristics of fluids to be distributed often resulted in varying performance of nozzle application rates. Application of external modifiers, such as the modulator units contemplated in U.S. Pat. No. 5,086,973 (Escallon) can be used in some instances to attempt to minimize discrepancies among application rates and resultant distribution thicknesses and the like, but are generally cumbersome, unwieldy to set up and adjust for varying applications, and do not overcome the problems of nonuniformity and inconsistency in all cases.

Consequently, the technology heretofore available has had limitations with respect to consistency and uniformity of application rate and resulting material thickness on a predetermined target in various applications. This was especially true where application tolerances were critical and relatively tight. Prior art nozzle assemblies and related equipment could not provide dependable uniform distribution of fluid across the width of a distribution nozzle dispensing opening with the increasingly high accuracy and uniformity demanded by these sophisticated application environments. As also mentioned, while the Wichmann et al. dispensing nozzle assembly provided a major advance in the adaptability and applicability of electrostatic dispensing nozzles, the present invention further improves the fluid distribution characteristics and advances the nozzle art to address these ever higher performance goals.

DISCLOSURE OF THE INVENTION

It is an object of this invention to obviate the above-described problems and shortcomings of electrostatic distribution equipment heretofore available in the industry.

It is another object of the present invention to provide an electrostatic fluid distribution nozzle capable of providing more reliable and uniform fluid distribution across the width of the nozzle outlet.

It is yet another object of the present invention to provide an improved electrostatic fluid distribution nozzle which includes an internal fluid distribution chamber structure which reliably insures more uniform and even supply of conductive fluid to the outlet opening of the nozzle in order to insure enhanced accuracy and uniformity of electrostatic dispensing from the nozzle across substantially the entire active width thereof.

It is also an object of the present invention to provide a uniform electrostatic fluid distribution nozzle having an internal fluid distribution chamber and a conductive shim associated therewith for charging the fluid for electrostatic dispensing operations, and wherein a network of discrete distribution channels is provided for evenly directing the fluid at relatively low pressure from an inlet to the dispensing outlet.

It is also an object of the present invention to provide an improved electrostatic fluid dispensing nozzle which has the capabilities of providing full width uniform fluid distribution across its outlet opening, while also featuring the potential for selectively controlling the active distribution width of the nozzle without degrading the uniformity of such distribution.

In accordance with one aspect of the present invention, there is provided a uniform distribution nozzle for electrostatic dispensing of conductive fluids, wherein the nozzle includes a nozzle body having a base and an attached cap, and an inlet for receiving fluid at a relatively low pressure. A substantially elongated outlet opening is provided on the nozzle for enabling distribution of the fluid, and a conductive shim is preferably included for providing an electrical charge to the fluid to enable electrostatic distribution from the nozzle. In a preferred embodiment, a plurality of distribution channels are provided to define discrete pathways within the nozzle for distributing and directing the fluid from the inlet to predetermined dispensing points along the outlet opening. The pathways have substantially equal flow characteristics (e.g., cross-sectional area, capacity and pathway lengths), so that fluid travels substantially equivalent distances and maintains substantially the same pressure between the inlet and the outlet opening, regardless of which particular pathway and dispensing point is involved. In order to facilitate the manufacture of the conductive shim with the required distribution channels, it may also be preferred to provide the conductive shim and distribution channels in the form of a plurality of layered shim plates to be mounted within the nozzle body. The distribution channels are part of the overall distribution chamber provided within the nozzle for receiving conductive fluid and directing it to the outlet opening in a uniform and consistent manner.

BRIEF DESCRIPTION OF THE DRAWINGS

While the specification concludes with claims particularly pointing out and distinctly claiming the present invention, it is believed the same will be better understood from the following description taken in conjunction with the accompanying drawings in which:

FIG. 6 is a partially broken out perspective view of a uniform electrostatic fluid distribution nozzle made in accordance with the present invention and having two inlets.

DETAILED DESCRIPTION OF INVENTION

Figure 1:
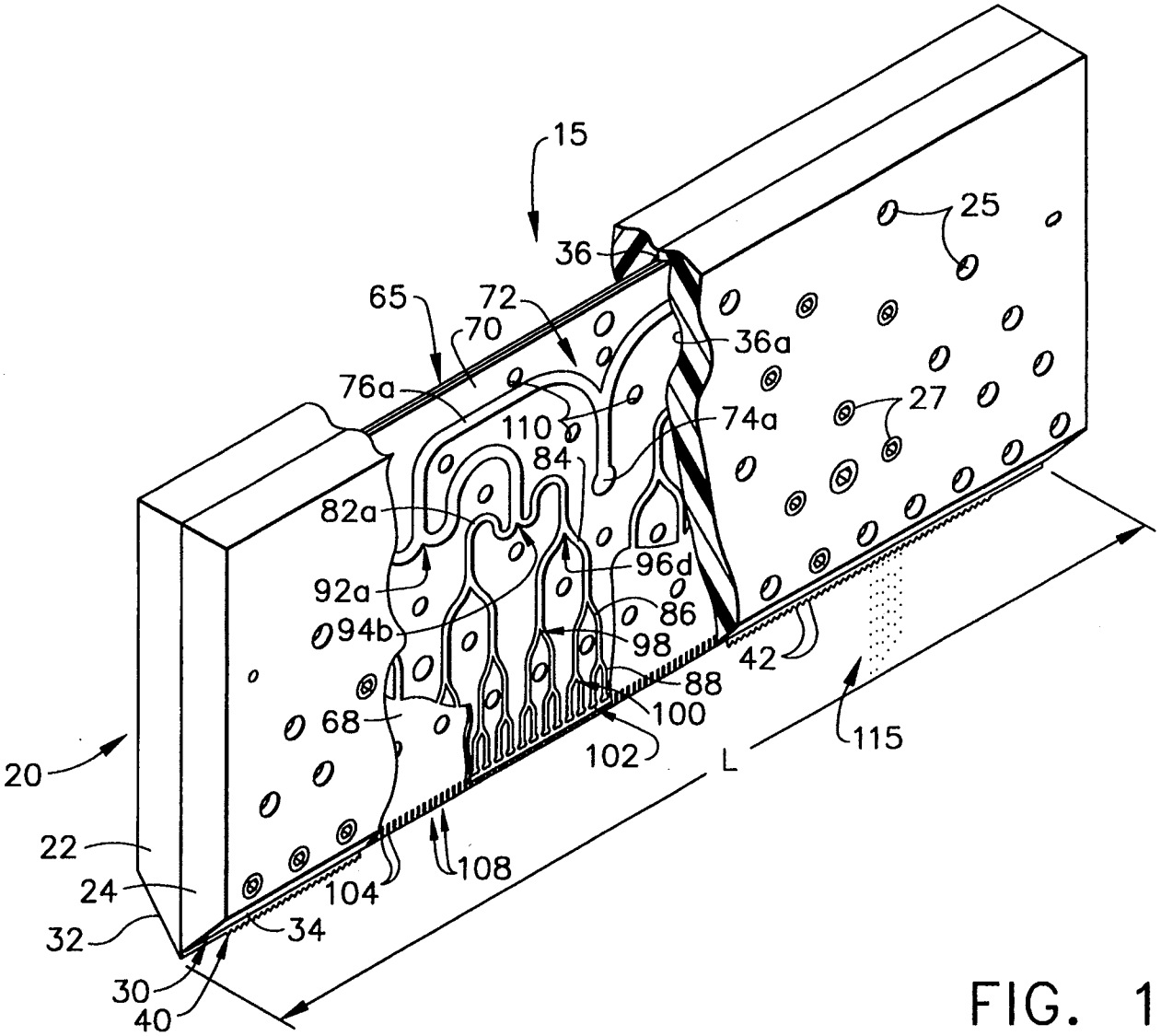
FIG. 1 is a partially broken out perspective view of a uniform electrostatic fluid distribution nozzle made in accordance with the present invention.

Referring now to the drawings in detail, wherein like numerals indicate the same elements throughout the views, FIG. 1 shows a partially broken out perspective view of a preferred embodiment of an electrostatic fluid dispensing nozzle 15 for conductive fluids made in accordance with the present invention. Particularly, dispensing nozzle 15 comprises a nozzle body generally indicated by numeral 20, which preferably includes a lower or base member 22 and an upper or cap member 24. Base and cap members 22 and 24 respectively, are preferably connected to define nozzle body 20 via plurality of connectors such as bolts 27 and threaded openings 26 of base 22. As will be understood, these connector devices (i.e., bolts 27) are accommodated in respective connector openings 25 appropriately provided in the cap member, as best illustrated in FIGS. 1–4. As will also be understood, because dispensing nozzle 15 can be oriented in substantially any position (e.g. vertically downward, horizontal, vertically upward, or in any of a variety of angles), the descriptors "lower" and "upper" are utilized solely for convenience and to provide some orientation in describing the structure of the present invention.

Figure 2:
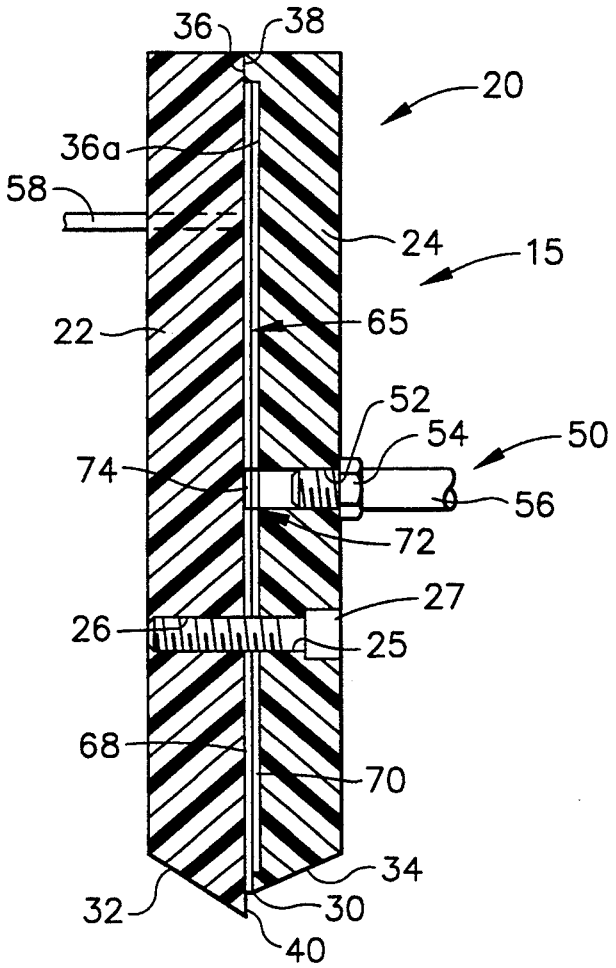
FIG. 2 is a vertical cross-sectional view of the distribution nozzle illustrated in FIG. 1.

Base member 22 comprises a lower tapered edge 32 having an extended tip or lip 40, which may optionally include a plurality of spaced charge concentrating tips 42, as will be described. Similarly, cap member 24 comprises a lower tapered edge 34 generally corresponding with tapered edge 32, and mating therewith to define an elongated outlet slot or dispensing edge 30. As seen in FIGS. 1 and 2, base and cap members 22 and 24 are connected adjacent their inner surfaces 38 and 36, respectively, to generally define nozzle body 20. As will also be discussed below, one or more of the inner surfaces 36 and 38 may preferably comprise a recess (e.g., recess 36*a*) for accommodating various means (e.g., shim 65) for providing a charge to the flowable fluid to be dispensed from nozzle 15.

As best seen in FIG. 2, a fluid inlet 50 is preferably provided to nozzle body 20 to connect nozzle 15 with a source of conductive, flowable fluid. Fluid inlet 50 preferably comprises an inlet passage 52 which may be internally threaded to receive a fluid coupling 54 connected with a fluid supply line 56.

Means 65 for providing an electrical charge to fluid from within nozzle 15 preferably comprises a relatively thin shim structure, illustrated in FIGS. 1–4 as preferably comprising an upper shim plate 68 and at least one lower shim plate 70. Dispensing nozzle 15 further comprises a distribution chamber generally indicated by the reference numeral 72 for receiving fluid from fluid inlet 50 therewithin. Distribution chamber 72 preferably comprises an inlet opening 74 (on shim plate 68) connected to a symmetrical network of distribution channels (e.g. channels 76*a* and *b*) via corresponding inlet opening or plenum 74*a* (on shim plate 70). Channels 76*a* and *b*, in turn, branch into a plurality of matched additional distribution channels for directing the fluid to a plurality of dispensing points (e.g. 108) equally space along elongated outlet slot 30 for dispensing operations.

As will be understood, fluid provided to dispensing nozzle 15 via supply line 56 will pass through inlet passage 52 to opening 74 of distribution chamber 72. In a preferred embodiment, distribution chamber 72 will be defined by recesses and/or openings which may be formed in one or more of the shim plates (e.g. 68 and 70 in the embodiment shown in FIGS. 1–4) and/or the nozzle body itself. Fluid inlet 50 is shown as being connected to nozzle body 20 through cap member 24. It should be understood that the fluid could be provided to the nozzle through either base member 22 or cap number 24, as desired. Upper shim plate 68 includes an inlet opening 74 which will be aligned with inlet passage 52 to receive fluid from within distribution chamber 72. Similarly, lower shim member 70 includes the corresponding inlet opening 74*a* which will be aligned with inlet 74 of the upper plate in use, and together openings 74 and 74*a* will provide a distribution plenum from which the fluid will be disbursed within distribution chamber 72.

Figure 3:
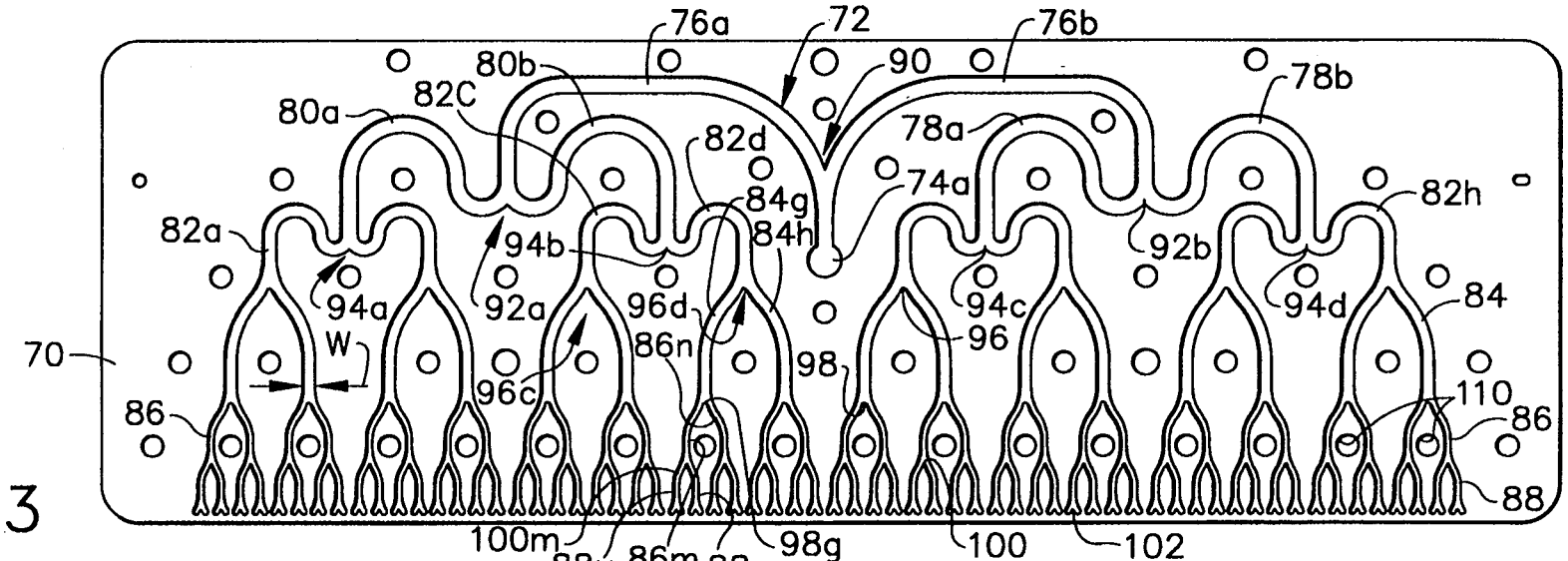
FIG. 3 is a plan view of lower shim plate of the conductive shim of the fluid distribution nozzle illustrated in FIG. 1.

As best seen in FIGS. 1 and 3, from distribution plenum/inlet opening 74*a*, fluid provided to dispensing nozzle 15 at a predetermined, relatively low pressure (e.g. approximately 10 psi or less) will proceed to first branch 90, where it will be evenly divided to flow along the oppositely disposed matching distribution channels 76*a* and *b*. As used herein, the term "matched" or "matching" with respect to the distribution channels shall connote that such channels have substantially equivalent fluid flow characteristics, including cross-sectional area, capacity, and length. In this regard, matching distribution channels will be substantially identical in a structure, although that need not necessarily be true in all applications. As will be appreciated, the distribution channels of the present invention resembles somewhat the nature of a Christmas tree or bracket tree, whereby fluid will enter nozzle 15 from a single inlet and be evenly distributed under substantially constant pressure to a plurality of dispensing points (e.g., 108) spaced along dispensing edge 30. As mentioned, these channels can be formed within the inner walls of distribution chamber 72, as recesses or slits within shim 65, and/or by a combination of the shim and distribution chamber structure.

Following the distribution channels shown best in FIG. 3, it will be understood that fluid will be evenly distributed down through both sides of the matched channels of the distribution channel 72 as it passes through successive distribution channels and branches. For example, fluid moving along distribution channel 76*a* will reach branch 92*a*, follow one of the channels 80*a* or 80*b*, and eventually reach one of the next set of branches 94(*a–b*). Fluid traveling along channel 80*b* will encounter branch 94*b*, then continue along either channel 82*c* or 82*d* to branch 96*c* or 96*d*, respectively. Fluid traveling along channel 82*d* will encounter branch 96*d*, and will continue along either channel 84*g* or 84*h*. Fluid traveling along channel 84*g* will encounter branch 98*g*, and will then pass on to either channel 86*m* or 86*n*. Fluid flowing through channel 86*m* will encounter branch 100*m*, and will continue on through either channel 88*y* or 88*z* accordingly. Fluid continuing on through channel 88*y* will then encounter branch 102, where it will be directed to one of the two aligned and spaced dispensing slits 104 formed in the lower edge 69 of upper shim plate 68 (see FIG. 4). In this way, it will be seen that fluid entering distribution chamber 72 will be systematically and uniformly distributed to one of the dispensing slits 104 via a discrete path provided by a matching pair of distribution channels and branches defined by recesses formed in the respective shim plates 68 and 70.

Because the shim plates will often be provided in the form of a thin sheet (e.g. between about 3 and 10 mils) of stainless steel or the like, provision of the channels and branches, such as by chemical or photo-etching processes, will ten,d to weaken the structural integrity of the shim assembly. Consequently, it is preferred that when a multitude of relatively closely situated dispensing points 108 are desired for a particular dispensing nozzle 15, a plurality of shims should be utilized in a layered arrangement, as illustrated in the drawing figures. In this way, some of the required openings, channels, branches, and slits can be formed in alternate shim plates which will be placed and layered face-to-face arrangement. In other applications, it may be preferred to provide only one or two thicker shim plates, wherein respective channels might be etched into surfaces thereof without being cut all the way through the shim plate thickness.

While it is contemplated that the channels and recesses could also be formed at least partially along the inner surfaces of the nozzle body 20, it is preferred to provide the bracket-type matching distribution channels via the shim assembly to simplify manufacturing procedures, and to maintain optimum flexibility and adaptability of the nozzle assembly of the present invention. In this way, a modular nozzle body (e.g., 20) might be mass-produced for use with a variety of interchangeable shim assembly designs.

Figure 4:
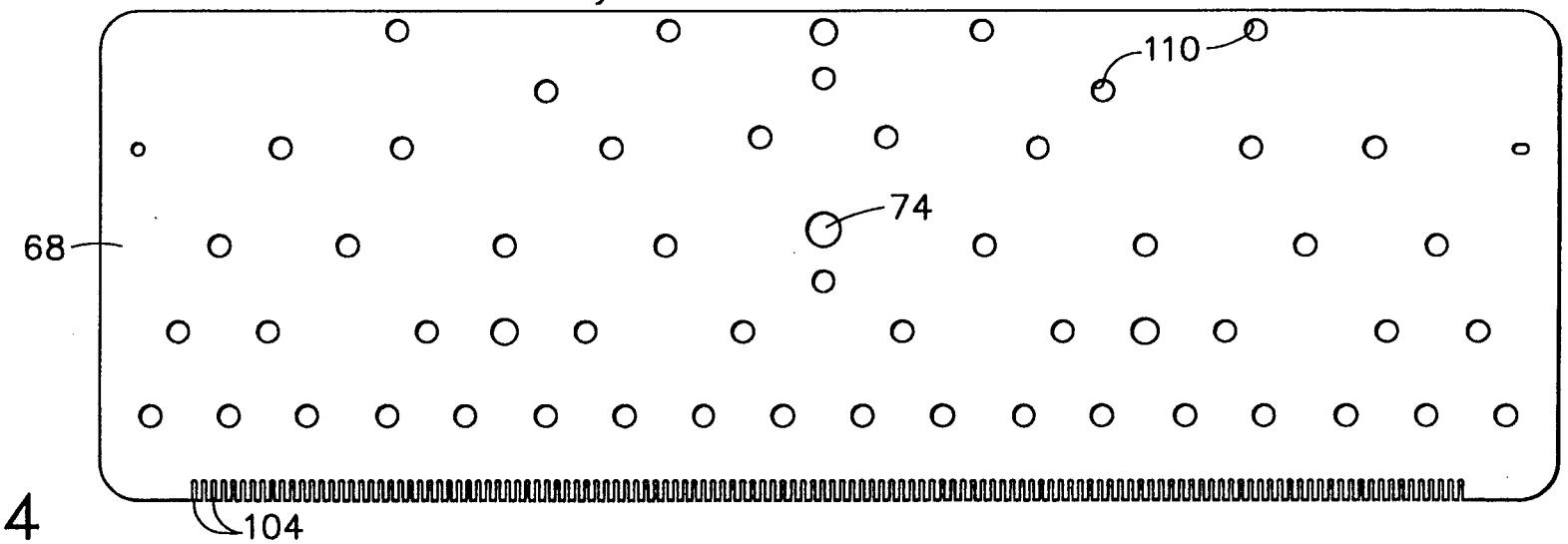
FIG. 4 is a plan view of the upper shim plate of the conductive shim of the fluid distribution nozzle illustrated in FIG. 1.

As also seen in FIGS. 1, 3 and 4, upper and lower shim plates 68 and 70 are further provided with a plurality of connector accommodation openings 110, which will align and correspond with connector openings 25 and 26 in base and cap members 22 and 24, respectively. As will also be understood, placement of these connector openings and attachment of bolts (e.g., 27) can be utilized to ensure proper sealing of nozzle body 20 and its internal distribution chamber 72. Particularly, by appropriately torquing the connections between base, member 22 and cap member 24, the shim plates (e.g., 68 and 70) can be held in tightly compressed, face-to-face relationship. Consequently, fluid flow will be restricted solely to the distribution channels, branches, and dispensing slits, ensuring that fluid entering inlet 50 and inlet opening 74 of the shims will pass through distribution chamber 72 and be guided to the predetermined dispensing points 108 adjacent the lower edges of dispensing slits 104. This arrangement also minimizes the need for auxiliary seals or gasketing which have been traditionally required in electrostatic nozzles.

In use, fluid will be provided from a low pressure source (not shown) to inlet 50 and corresponding inlet openings 74/74*a* of the conductor shim assembly. From there, the fluid will be evenly distributed through the distribution channels, branches, and dispensing slits of distribution chamber (e.g., 72) of the nozzle structure. The matching and equivalent design of the bracket-type distribution channel system of the present invention is designed to ensure smooth and equal flow of the fluid along each of the individual discrete pathways between inlet opening and the lower edges of dispensing slits. Each of these discrete pathways, is designed to have substantially identical pathway lengths as measured between inlet opening 74 and any one of the dispensing points 108 adjacent the lower edge of the individual dispensing slits 104. While the actual value of the pathway length is not relevant so long as each of the pathway lengths are substantially equivalent, such lengths will be determined at least in part based upon the number of dispensing points required and the overall dispensing length L of the dispensing nozzle 15.

It will also be noted that the flow size of the matching distribution channels (e.g., 76*a* and *b*, 78*a* and *b*, 80*a* and *b*, etc.) will preferably be designed such that the change in pressure of the fluid between fluid inlet 50 and dispensing outlet slot 30 is minimized. Particularly, as a result of a preferred progressive decrease in cross-sectional area of successive pathway branches, there may be a slight pressure rise as fluid is distributed from inlet 50 to the individual dispensing points 108. It is also preferred, however, that the pressure of the fluid within dispensing nozzle 15 remain relatively low at all times, and that the change in pressure within the nozzle be minimized generally.

An example of a typical decrease in cross-section width of adjacent pathway branches might find the respective lateral widths (e.g., W shown in FIG. 3) for channels 88, 86 and 84 at about 0.03 inches (0.76 mm), 0.06 inches (1.5 mm), and 0.12 inches (3.05 mm), for dispensing silicon rubber or similar elastomer type fluids. It will be understood, however, that particular sizing of the pathway channels of the present invention may vary from application to application depending upon variables including the nature and viscosity of the fluid to be dispensed, the required flow rate of the nozzle, and the like. Additionally, whether or not particular successive pathway branches are of different cross-sectional areas or widths, and how much of a difference exists, will be based on flow characteristics, manufacturing preferences, and the like.

It should also be emphasized that, while discrete passageways may be preferred, they are not required to successfully implement the present invention. For example, the distribution channels could be defined by one or more plenum-like distribution recesses designed to receive liquid and evenly distribute the same to outlet branches. Such a plenum-like recess might be provided in the form of a delta shaped chamber which receives liquid at an inlet and evenly distributes such liquid via an outwardly flared delta-shaped flow pattern, which can itself be connected to a plurality of other similar recesses, branches or the like. The distribution chamber can thereby be provided by numerous structural combinations, but must provide pathways having substantially equal flow characteristics to insure uniform distribution of the fluid adjacent the nozzle's outlet opening.

Once the fluid is uniformly distributed to dispensing points 108, the actual dispensing of the fluid from the nozzle will be substantially identical to electrostatic dispensing nozzles heretofore available, such as set forth in the Wichmann et al. patent application referenced herein. Sufficiently high voltage can be provided to shim plates 68 and 70 such as through voltage terminal 58 (seen best in FIG. 2). Dispensing nozzle 15 can be mounted in a variety of orientations and combinations which have been adequately described in the prior art. Distribution enhancing structures such as voltage intensifiers, inductor bars, modulator arrangements, and the like, can also be utilized with the improved dispensing nozzles of the present invention, and details of those structures will not be set forth specifically herein.

The dispensing nozzle of the present invention has been found to provide more uniform flow and distribution of fluid for electrostatic dispensing as a result of the bracket-type discrete pathways of equal fluid flow characteristics, as described herein. Particularly, fluid is equally distributed within distribution chamber 72 along discrete pathways of substantially equal length, volume, and other flow characteristics, such that the fluid is maintained and provided with substantially equal pressure to each of the dispensing points 108 at all times. It is also contemplated that means (not shown) might be provided for selectively controlling symmetrical portions of distribution chamber 72, whereby corresponding pairs of spaced dispensing points 108 might be selectively activated/deactivated to even more precisely control the distribution pattern and/or characteristics of dispensing nozzle 15.

For example, the effective dispensing length L of nozzle 20 might be varied by selectively activating and/or deactivating corresponding pairs of the outermost dispensing points 108, such as by closing off corresponding pairs of branches (e.g., 1102, 100, 98 etc.). So long as symmetrical activation/deactivation is undertaken, dispensing nozzle 15 will continue to deliver fluid on a uniform basis to the dispensing points 108 which remain active. As will be appreciated, it may be preferred to provide charge concentrating tips 42 on the extended lip 40 to correspond with the individual dispensing points 108 desired in a particular application. In this regard, serrated tips 42 preferably correspond and align with individual dispensing slits 104 as described above. This one to one correspondence has been found to further enhance the dependability and uniformity of flow characteristics of the nozzles of the present invention.

Figure 5C:
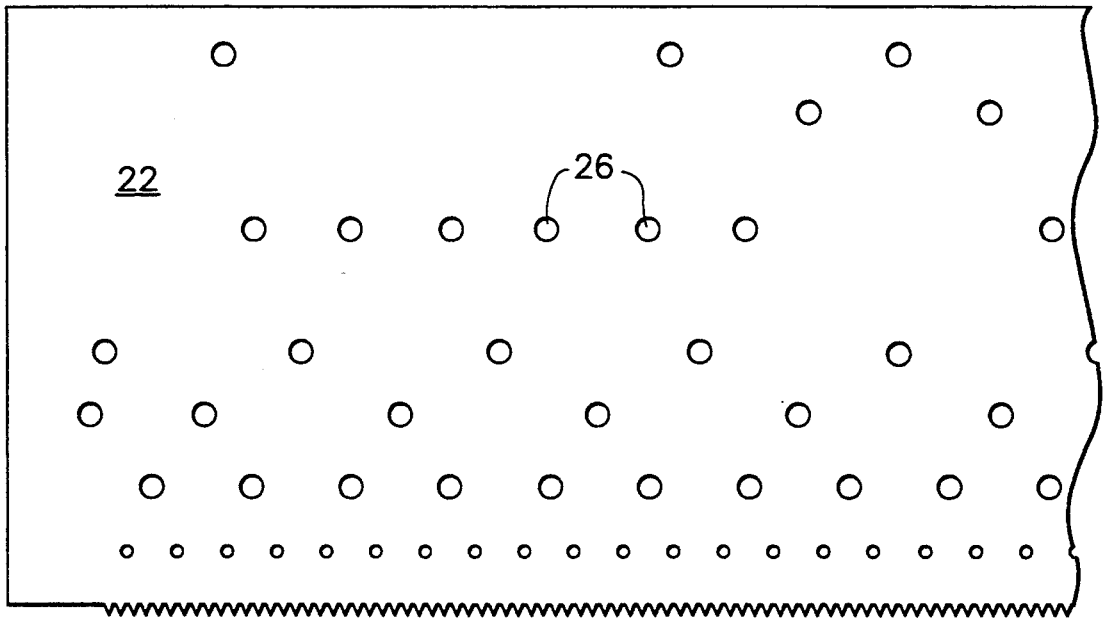
FIG. 5C is a fragmentary elevational view illustrating the base member of the embodiment of FIGS. 5A and 5B.
Figure 5A:
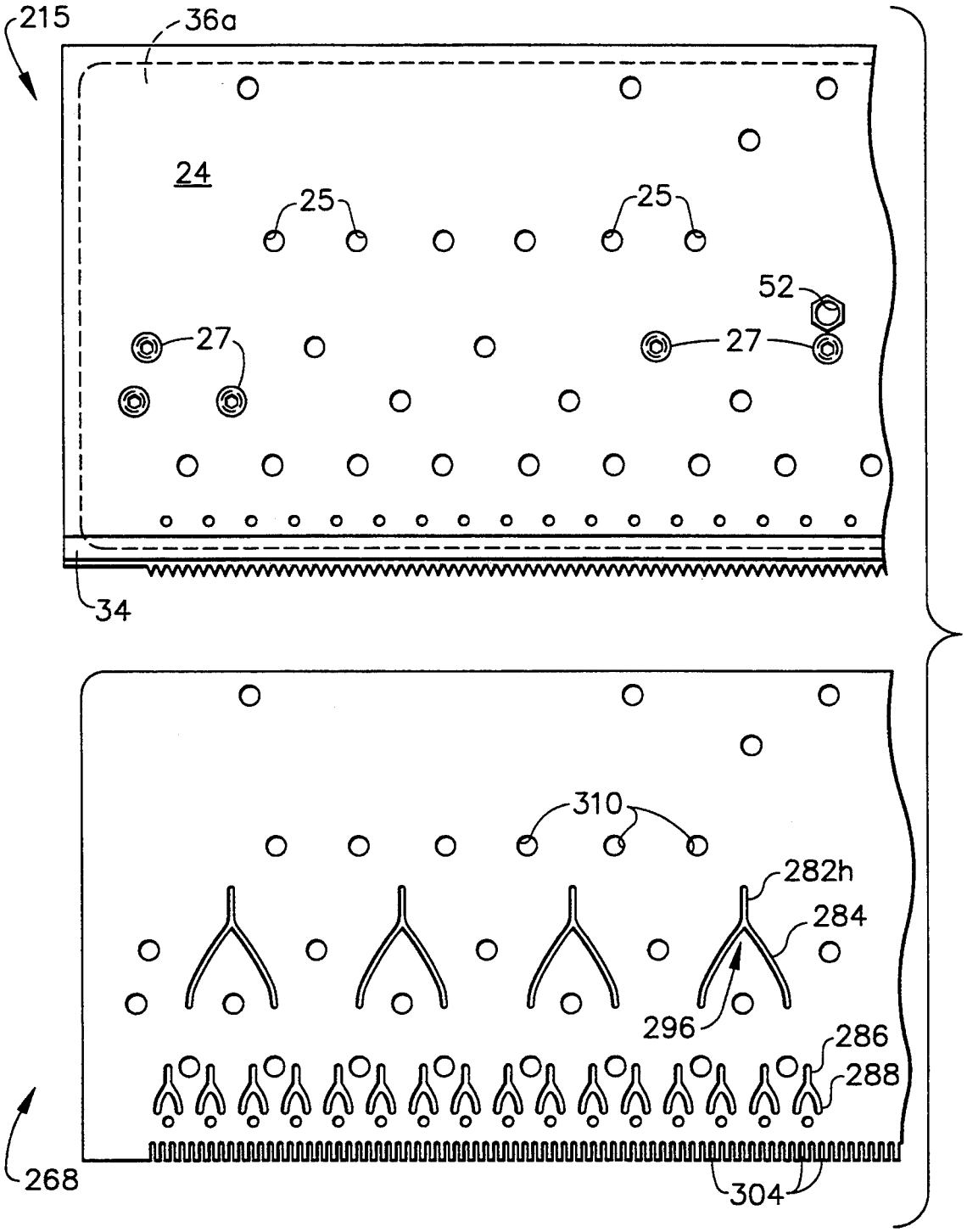
FIG. 5A is a fragmentary, exploded, elevational view of another embodiment of nozzle of the present invention, illustrating a cap member and a first shim plate thereof.
Figure 5B:
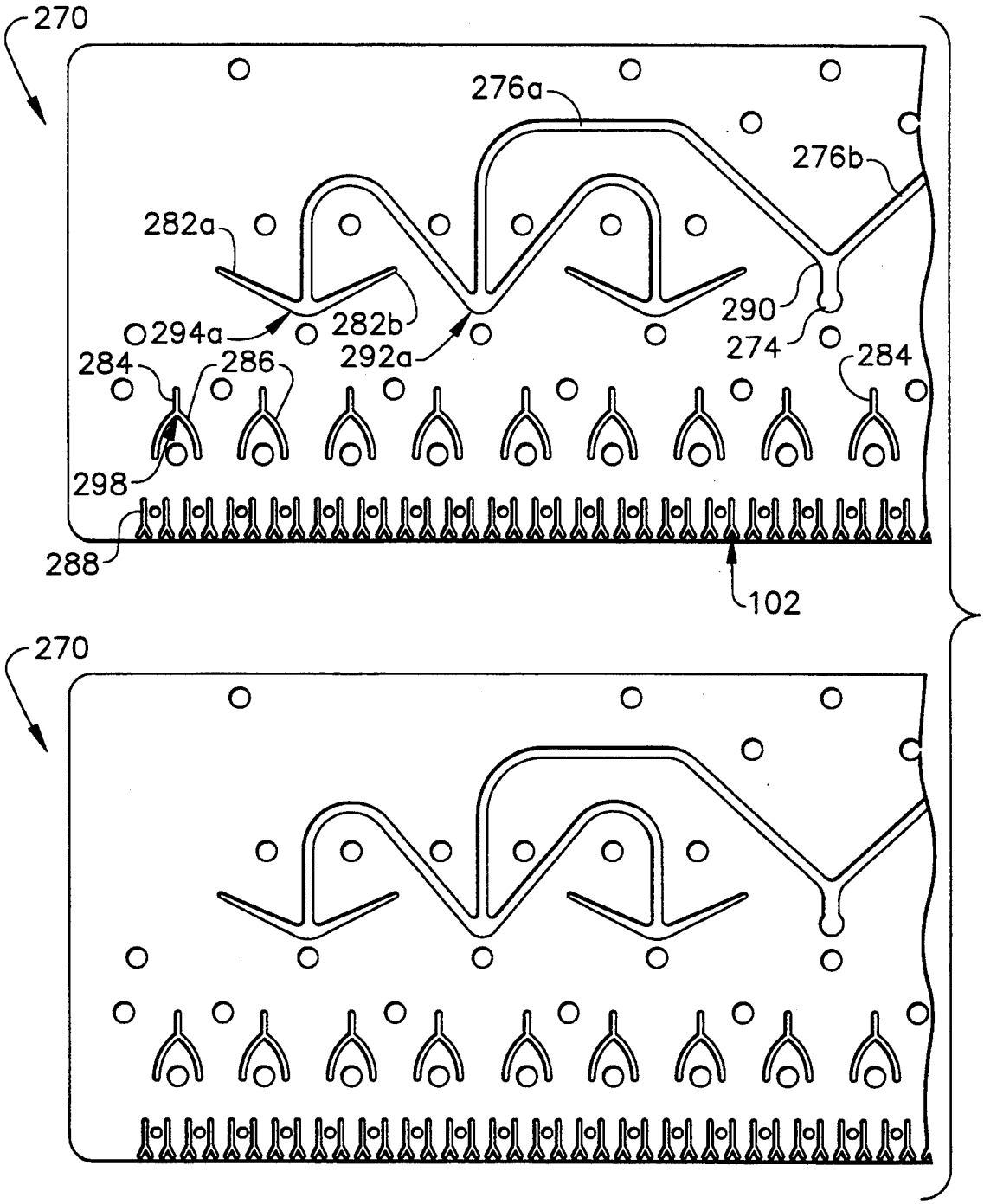
FIG. 5B is a fragmentary, exploded, elevational view illustrating additional shim plates of the embodiment of FIG. 5A.

FIG. 5 (shown as FIGS. 5A, 5B and 5C) illustrates a partial, exploded view of a dispensing nozzle 215 designed in accordance with the present invention. Particularly, dispensing nozzle 215 includes base member 22 (FIG. 5C) and cap member 24 (FIG. 5A) in substantially identical form to that described above with respect to nozzle 15. The means 265 for providing an electrical charge to fluid within nozzle 215 is shown as an alternate embodiment comprising an upper shim plate 268 (FIG. 5A) and a plurality of lower shim plates 270 (FIG. 5B). In some applications, where relatively intricate distribution channels, branches, and slits are to be formed in one or more shim plates, it may be desirable to utilize a larger number of layered shim plates.

In the embodiment shown in FIGS. 5A–C, lower shim 270 might be provided in the form of a plurality (e.g., 5) of shim plates having only portions of the various discrete distribution channels (e.g., 276*a* and *b*, 292*a*, 282*a* and *b*, 284, 2136 etc.) formed therein, while the balance of the discrete pathways are provided in upper shim plate 268 (e.g., portions of channels 282*h*, 284, 286, 288, etc.). As this embodiment illustrates, any combination of shim plates providing the required discrete pathways for evenly distributing fluid from an inlet opening (e.g., 274) to a plurality of dispensing points adjacent the spaced dispensing slits 304 can be utilized. This further augments the practical adaptability and relative simplicity with which-the present invention can be applied to a variety of sophisticated dispensing applications. It will also be understood that utilization of multiple layers of upper and/or lower shim plates can also be utilized to "tune" the flow capacity of various portions of the discrete pathways, as necessary or desired.

When a nozzle length L' is required which would be more than can be efficiently served by a single fluid inlet, it would be within the scope of the invention to provide the nozzle with a plurality of inlets and associated distribution chambers, wherein each distribution chamber comprises a plurality of distribution channels for guiding fluid from the respective inlets to a plurality of distinct dispensing points along the outlet opening of the nozzle. An exemplary nozzle having a second inlet and associated distribution chamber is illustrated in FIG. 6. The first inlet and its associated distribution chamber are given the same index numerals as found in FIG. 1. The second inlet and its associated distribution chamber are given the same index numerals followed by a "'". It will be understood that the operation of inlet 74*a*' and its distribution chamber 72' is identical to that set forth with respect to inlet 74*a* and distribution chamber 72 in the description of the structure of FIG. 1.

Having shown and described the preferred embodiments of the present invention, further adaptions of the uniform electrostatic fluid dispensing nozzle of the present invention can be accomplished by appropriate modifications by one of ordinary skill in the art without departing from the scope of the present invention. Several of such potential modifications have been mentioned, and others may become apparent to those skilled in the art. Accordingly, the scope of the present invention should be considered in terms of the following claims, and is understood not to be limited to the details of structure and operation shown and described in the specification and drawings.

We claim:

1. An electrostatic dispensing nozzle having a nozzle body comprising a base and a cap, said nozzle body having a fluid inlet, a fluid distribution chamber connected to said inlet for receiving fluid within said nozzle, an outlet opening connected to said fluid distribution chamber enabling discharge of fluid from said nozzle, means for providing an electrical charge to said fluid within said nozzle, said means comprising a metallic shim structure, said base and cap being joined together with said shim structure located therebetween, said cap and base defining therebetween an elongated slot comprising said outlet opening, said fluid distribution chamber comprising a network of a plurality of distribution channels providing discrete dispensing points along said outlet opening, said pathways having predetermined flow characteristics which are substantially matched, said distribution chamber being formed in said shim structure.

2. The dispensing nozzle of claim 1, wherein said nozzle comprises a plurality of discrete charge concentrating tips adjacent said outlet opening, said tips defining the location of said dispensing points therealong.

3. The fluid dispensing nozzle of claim 1, wherein said distribution channels comprise a plurality of discrete branches of substantially equivalent fluid flow characteristics.

4. The fluid dispensing nozzle of claim 1, wherein said fluid distribution channels comprise a plurality of matching pairs of branches which help direct the fluid to distinct dispensing points.

5. The dispensing nozzle of claim 1, further comprising a plurality of distribution chambers each having an inlet, wherein each distribution chamber comprises a plurality of said distribution channels for guiding fluid from its respective inlet to a plurality of distinct dispensing points along said outlet opening.

6. The electrostatic fluid dispensing nozzle claimed in claim 1 wherein said shim structure comprises at least two planar metallic plates in stacked relationship between said cap and said base, parts of said distribution chamber channels being located in each of said shim structure plates.

7. The electrostatic fluid dispensing nozzle claimed in claim 1 wherein said matched predetermined flow characteristics of said discrete pathways are such that said fluid to be dispensed travels with substantially equivalent volume, speed and pressure between said inlet and said outlet opening regardless of to which dispensing point it flows.

* * * * *